US005407369A

United States Patent [19]

Oster

[11] Patent Number: 5,407,369

[45] Date of Patent: Apr. 18, 1995

[54] BATTERY CLAMP

[76] Inventor: Douglas D. Oster, 6655 Union Lake Trail, Lonsdale, Minn. 55056

[21] Appl. No.: 690,511

[22] Filed: Apr. 24, 1991

Related U.S. Application Data

[63] Continuation-in-part of Ser. No. 545,881, Jun. 29, 1990.

[51] Int. Cl.[6] ..... H01R 4/42

[52] U.S. Cl. ..... 439/762; 439/765

[58] Field of Search ..... 439/757, 758, 761–765, 439/874

[56] References Cited

U.S. PATENT DOCUMENTS

| | | | |
|---|---|---|---|
| 1,845,089 | 2/1932 | Kionka | 439/758 |
| 2,049,649 | 8/1936 | Heitman | 439/758 |
| 2,057,542 | 10/1936 | Slavins . | |
| 2,086,048 | 7/1937 | Redinger | 439/758 |
| 2,154,507 | 4/1939 | Hunefeld et al. . | |
| 2,247,452 | 7/1941 | Seils . | |
| 2,287,490 | 6/1942 | Tenney . | |
| 2,305,504 | 12/1942 | Tenney . | |
| 2,493,389 | 1/1950 | Casey . | |
| 2,551,463 | 12/1953 | Johnson . | |
| 2,577,714 | 12/1951 | Proff . | |
| 2,730,691 | 1/1956 | Nelson . | |
| 2,860,319 | 11/1958 | Short | 439/758 |
| 3,189,867 | 6/1965 | Kaashoek . | |

FOREIGN PATENT DOCUMENTS

| | | | |
|---|---|---|---|
| 0764611 | 8/1967 | Canada | 439/762 |
| 2606043 | 9/1976 | Germany . | |
| 3215524 | 11/1983 | Germany . | |
| 1404182 | 8/1975 | United Kingdom . | |

*Primary Examiner*—David Pirlot

*Attorney, Agent, or Firm*—Schwegman, Lundberg and Woessner

[57] ABSTRACT

Battery clamp including a nut molded into one of the clamping arms and a rotatable bolt with a flanged shaft molded into the other clamping arm. The head of the bolt, flange, and nut provide bearing surfaces for drawing the clamping arms together, or forcing the clamping arms apart, depending upon the rotation of the bolt. The battery clamp is manufactured in a single molding process by pre-threading the nut onto the flanged bolt to a predetermined position, positioning the pre-threaded nut and bolt in one portion of a battery clamp mold, assembling the remaining pieces of the battery clamp mold around the bolt and nut, securing the pieces of the battery clamp mold together, pouring lead or a lead alloy into an opening in the battery clamp mold, quenching the lead filled mold in a liquid bath to accelerate the cooling process, separating the secured mold pieces after the lead or lead alloy cools, and removing the molded battery clamp.

3 Claims, 9 Drawing Sheets

FIG. 1
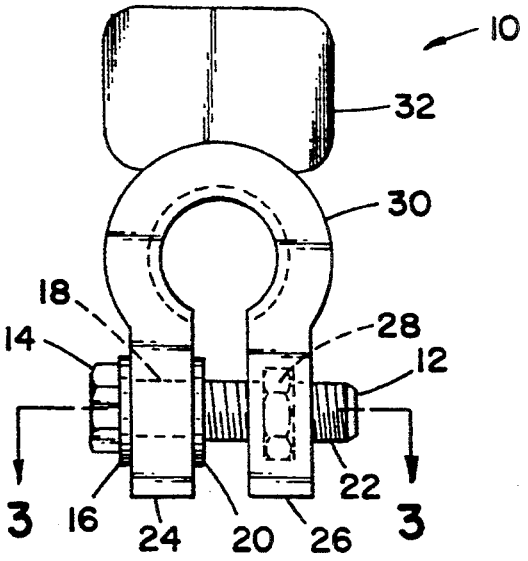
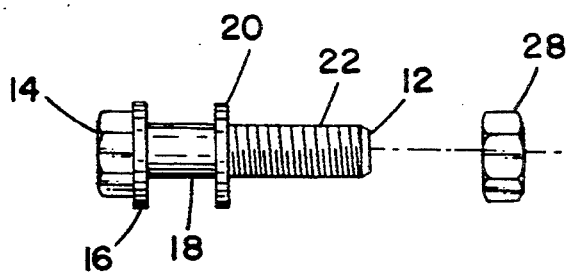
FIG. 2
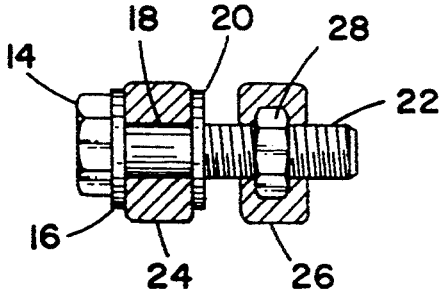
FIG. 3

BATTERY CLAMP

CROSS REFERENCES TO CO-PENDING APPLICATIONS

Continuation-in-part of U.S. patent application, Ser. No. 07/545,881, filed Jun. 29, 1990, entitled BATTERY CLAMP AND PROCESS FOR MANUFACTURING SAME, by Douglas D. Oster.

BACKGROUND OF THE INVENTION

The present invention relates to a battery clamp, and more particularly, to a battery clamp including a rotating bolt with flanges cast into one clamping arm and a nut cast into the other clamping arm of the battery clamp.

Prior art battery clamps are designed with a tensioning means for drawing the clamping arms together. Because battery clamps are generally constructed from a soft molded lead or lead alloy, removing the battery clamp from a battery terminal usually requires prying the clamping arms apart or special tooling to pull the battery clamp off the battery terminal without damaging the battery.

When the clamping arms are forced apart, the terminals are often damaged. Damage to the battery posts usually requires replacing the battery because breakage of the terminals often entails breakage of the battery housing. Further, forcing the clamping arms apart generally damages the soft lead alloy of the clamping arms beyond repair. Finally, terminal pullers are not always readily available, especially for emergency road-side repairs.

The manufacture of prior art battery clamps tends to be labor intensive. After the body of the battery clamp is cast, some type of bolt and nut assembly must be combined with the casting to form the finished battery clamp. Special fixtures are often employed to accurately insert the bolt and nut into the clamping arms.

The present invention overcomes disadvantages of prior art by providing a battery clamp with an integral structure whereby the rotation of the bolt in one direction brings the clamping arms together and rotation in the other direction forces them apart. The invention also takes advantage of the low friction between lead materials and other harder metals, particularly steel. Because lead and lead alloys do not adhere to the bolt, the bolt and nut can be cast directly into the clamping arms of the battery clamp without interfering with the rotation of the bolt and operation of the battery clamp.

SUMMARY OF THE INVENTION

The present invention is directed to a battery clamp with structure which is molded into the clamp for pulling the clamping arms together and forcing the clamping arms apart, depending upon the direction of rotation of the bolt. A flanged bolt with a pre-threaded nut is cast directly into the clamping arms of the battery clamp so that the head and flanges of the bolt are cast into one clamping arm, while the nut is cast into the other clamping arm.

According to one embodiment of the present invention, the body of the battery clamp includes a connecting member and two clamping arms extending therefrom. A connecting plate extending from the other side of the connecting member. After casting, the connecting member, clamping arms, and connecting plate are formed by a continuous piece of lead material, generally comprising lead or a lead alloy. The bolt, which is a standard configuration and commonly available, contains flanges which are separated from the head by a smooth radial shaft. The bolt and pre-threaded nut are cast into the connecting arms of the battery clamp. The flanges serve as bearing surfaces which engages with the lead material of one of the clamping arms, while a nut molded into the other clamping arm engages with the threaded portion of the bolt. The clamping arms are either drawn together or forced apart, depending upon the rotation of the bolt.

According to an alternative embodiment of the present invention, a single flanged bolt is utilized, whereby the flange is separated from the head of the bolt by a smooth radial shaft. The single flange of the bolt can be either cast in a recess of one of the clamping arms or adjacent thereto.

A significant aspect of the present invention is casting the battery clamp using the technique discussed herein. The bolt is positioned in the mold so that the pre-threaded nut is centered in the clamping arm indentation of the mold. The inner flange of the bolt can be positioned either adjacent to the clamping arm separation in the mold or in a recess within the clamping arm indentation. The pieces of the mold are secured together and a lead material is poured in through an opening in the mold, thereby casting the bolt and nut directly into the clamping arms of the battery clamp.

The present invention utilizes the low friction characteristics of lead and lead alloys with respect to steel. After casting, the bolt, generally of a steel material, does not adhere to the lead material and turns freely in the clamping arms.

Having thus described the preferred embodiments of the present invention, it is a principal object hereof to provide a battery clamp and method for manufacturing the same in which a flanged bolt draws the clamping arms together or forces the arms apart depending upon the direction of rotation of the bolt.

BRIEF DESCRIPTION OF THE DRAWINGS

FIG. 1 illustrates a top view of a battery clamp according to the present invention;

FIG. 2 illustrates an exploded view of a double flanged bolt and the nut;

FIG. 3 illustrates an end view of the battery clamp and the location at which the double flanged bolt is cast into the battery clamp arms;

DESCRIPTION OF THE PREFERRED EMBODIMENTS

Figure 4:
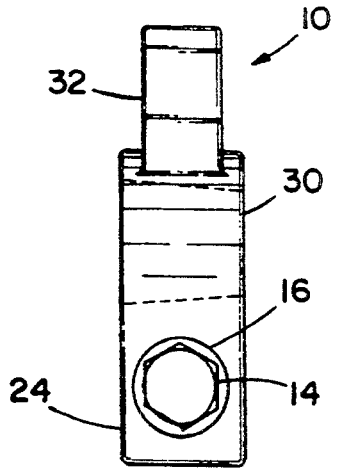
FIG. 4 illustrates a left side view of the molded battery clamp.

FIG. 1 illustrates a top view of a battery clamp 10 including the bolt 12. The head 14 and nut 28 cast directly into the clamping arms 24 and 26, respectively. The head 14 and outer flange 16 are adjacent to the outer side of clamping arm 24. The radial shaft 18 separates the outer flange 16 from the inner flange 20. The inner flange 20 is adjacent to the inner side of the clamping arm 24. The threaded shaft 22 passes through the clamping arm 26 and engages the nut 28. The arms 24 and 26, the connecting member 30, and the connecting plate 32 form a continuous piece of molded lead material.

FIG. 2 illustrates an exploded view of the bolt 12 and the nut 28, where all numerals correspond to those elements previously described. The bolt and nut are of a standard configuration, commonly available from a numerous hardware suppliers. The bolt and nut of the present invention are constructed of a steel alloy, which does not adhere to the molten lead material. After the lead hardens, the bolt turns freely in the soft lead material of the battery clamp. The inner flange 20 and outer flange 16, separated by the radial shaft 18, form bearing surfaces against the softer lead material of the clamping arm 24. When rotational force is applied to the head 14, the nut 28 remains stationary in the clamping arm 26.

FIG. 3 illustrates an end view of FIG. 1 where all numerals correspond to those elements previously described. This figure illustrates the position of the bolt 12 and the nut 28 in the clamping arms 24 and 26.

Figure 5:
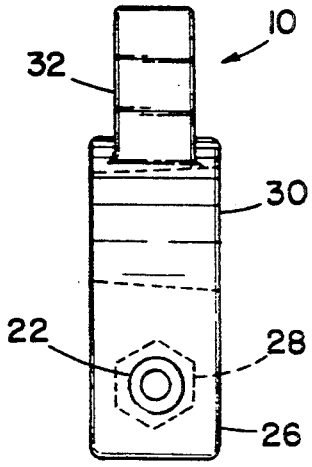
FIG. 5 illustrates a right side view of the molded battery clamp.
Figure 6:
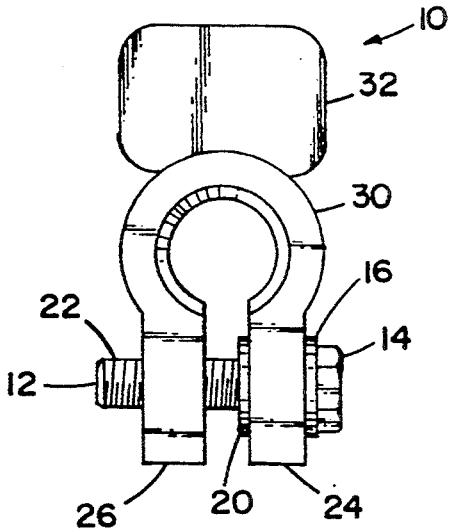
FIG. 6 illustrates a bottom view of the molded battery clamp.
Figure 7:
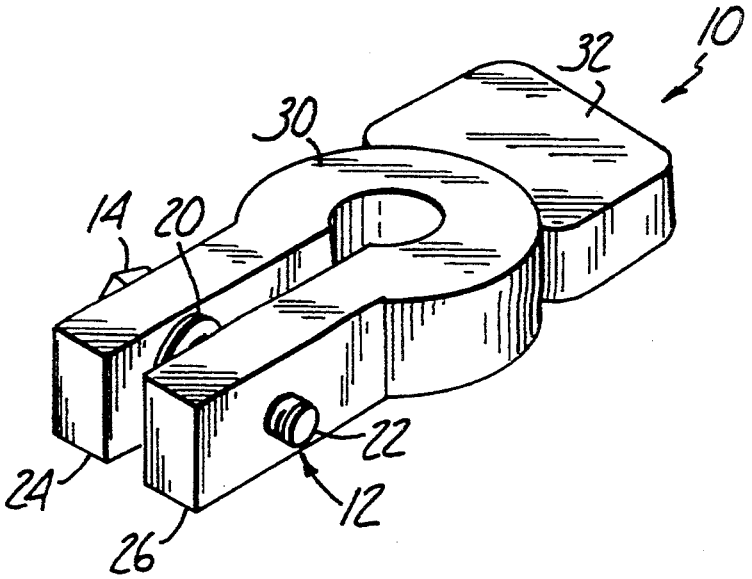
FIG. 7 illustrates a perspective view of the molded battery clamp.

FIG. 4 illustrates a left side view of the molded battery clamp 10, where the head 14 and the outer flange 16 are adjacent to arm 24. FIG. 5 illustrates a right side view of a battery clamp 10, where the threaded shaft 22 engages the nut 28, but rotates freely in the clamping arm 26. FIG. 6 illustrates a bottom view of the battery clamp 10. Finally, FIG. 7 illustrates a perspective view of the battery clamp 10 where all numerals correspond to those elements previously described.

Figure 8:
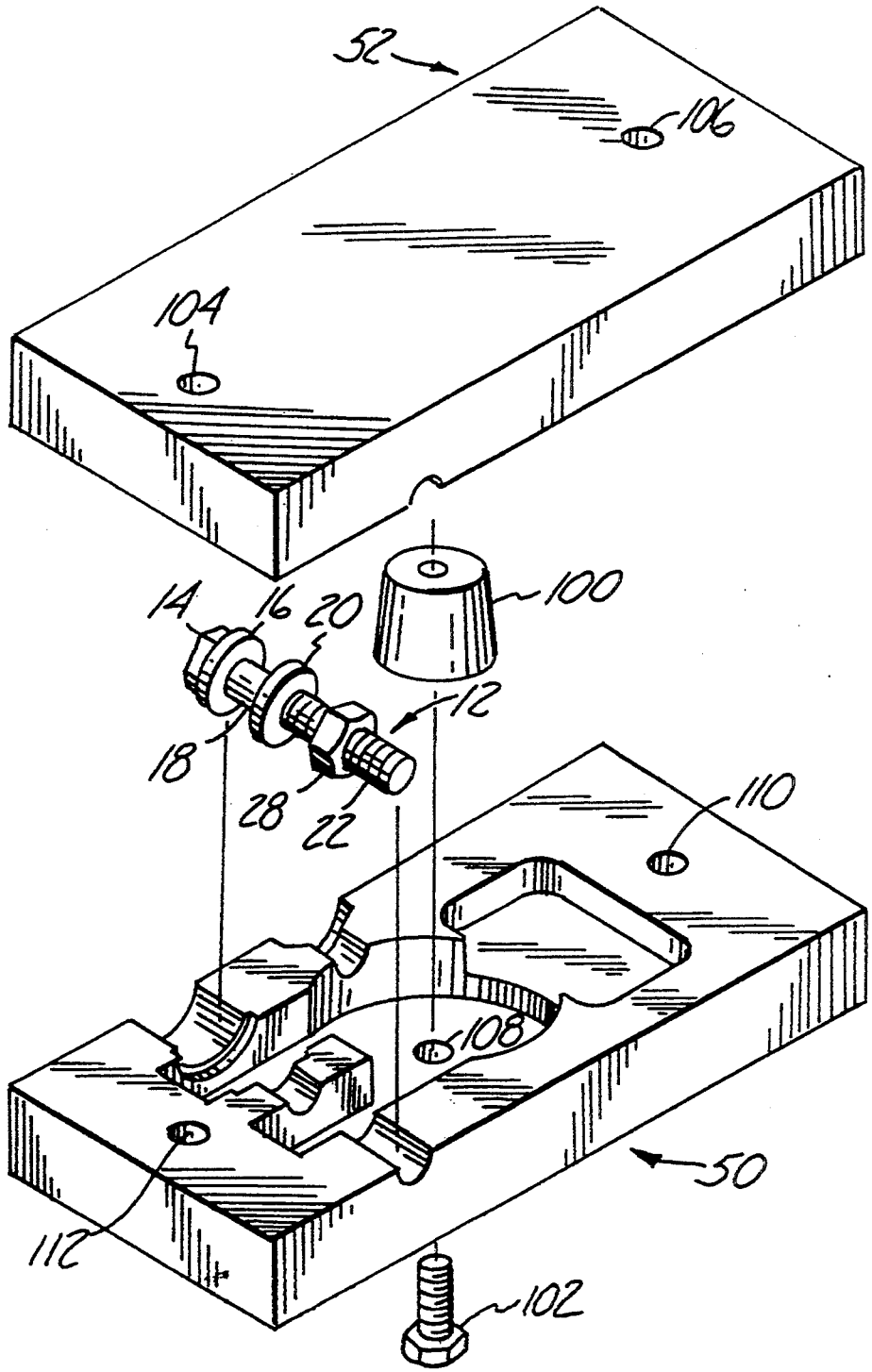
FIG. 8 illustrates an exploded perspective view of the mold of the preferred embodiment, including the flared battery post and nut, and the double flange bolt and nut.

FIG. 8 illustrates an exploded perspective view of the mold of the present invention, including a bottom mold half 50 and top mold half 52. The battery post mold insert 100 is attached to the bottom mold half 50 by the bolt 102, which passed through hold 108 in the mold. The molds 50 and 52 are secured together prior to pouring the lead alloy via bolts (not shown) which pass through holds 104 and 112, and 110 and 106 respectively.

Figure 9:
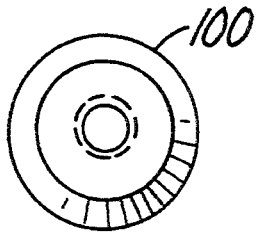
FIG. 9 illustrates a top view of the flared battery post.
Figure 10:
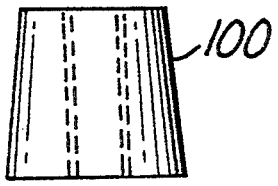
FIG. 10 illustrates a side view of the flared battery post.

FIG. 9 illustrates a top view of the flared battery post mold insert 100. FIG. 10 illustrates a side view of the flared battery post mold insert 100. Flaring the battery post aids in removing the molded battery clamp from the molds, as well as aiding in the installation and removal of the battery clamp from the battery terminal.

Figure 11:
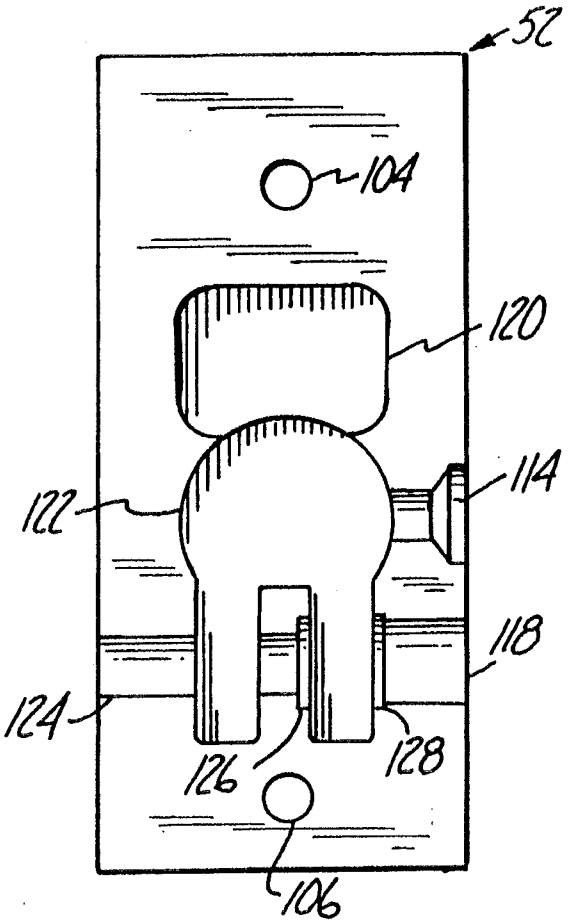
FIG. 11 illustrates a top view of the bottom half of the mold of the preferred embodiment.

FIG. 11 illustrates a top view of the top mold half 52, showing the hole 114 for pouring the lead alloy into the mold. The lead utilized by the Applicant to manufacture the battery clamp of the present invention was obtained by melting prior art battery clamps. However, it may be understood that a number of different lead alloys may be used to practice the present invention.

Indentations 120 for the clamping area and 122 for the body of the clamp are shown. The mold includes the appropriate indentations 118 for the head of the bolt and 124 for the threaded shaft. The indentations for the bolt head and shaft continue through the end walls of the molds 50 and 52. Special recesses 126 and 128 are machined into the molds to accept the inner and outer flanges 20 and 16, respectively.

Figure 12:
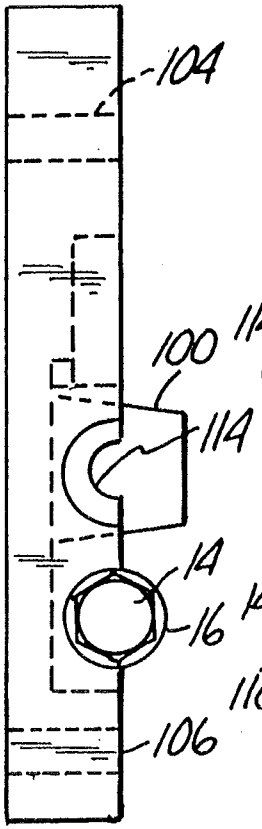
FIG. 12 illustrates a side view of the mold of the preferred embodiment.

FIG. 12 illustrates a left side view of the bottom mold half 50 showing the hole 114 for pouring in the lead material. The head 14 of bolt 12 and the outer flange 16 can be seen through the indentation 118. The flared battery post mold insert 100 is also shown.

Figure 14:
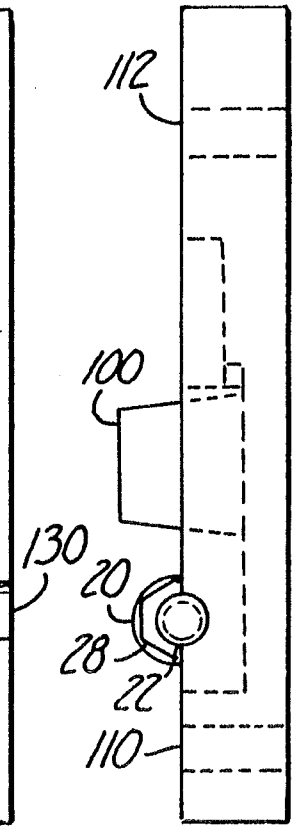
FIG. 14 illustrates a side view of the left hand side of the bottom of the mold.
Figure 13:
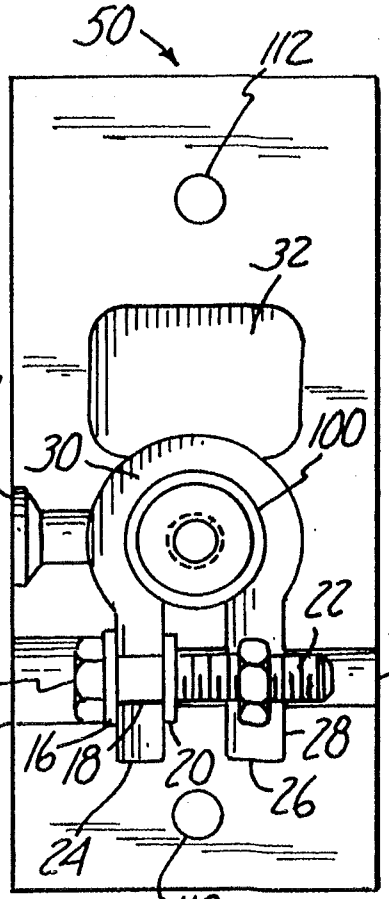
FIG. 13 illustrates a top view of the bottom half of the mold, including the positioning of the double flanged bolt prior to casing.

FIG. 13 illustrates a top view of the bottom mold half 50 with the bolt 12 and nut 28 positioned for casting. Also shown is the flared battery post 100 installed in bottom mold half 50. The bolt 12 is located in the mold so that the inner flange 20 is inserted in recess 126 on the inner side of clamping arm 24. The outer flange 16 is inserted in the recess 128 on the outer side of clamping arm 24. The pre-threaded nut 28 is positioned in the center of mold indentation for clamping arms 26. FIG. 14 illustrates a right side view of the bottom mold half 50 showing nut 28 and the end of the bolt 12 through indentation 124.

DESCRIPTION OF A FIRST ALTERNATIVE EMBODIMENT

Figure 15:
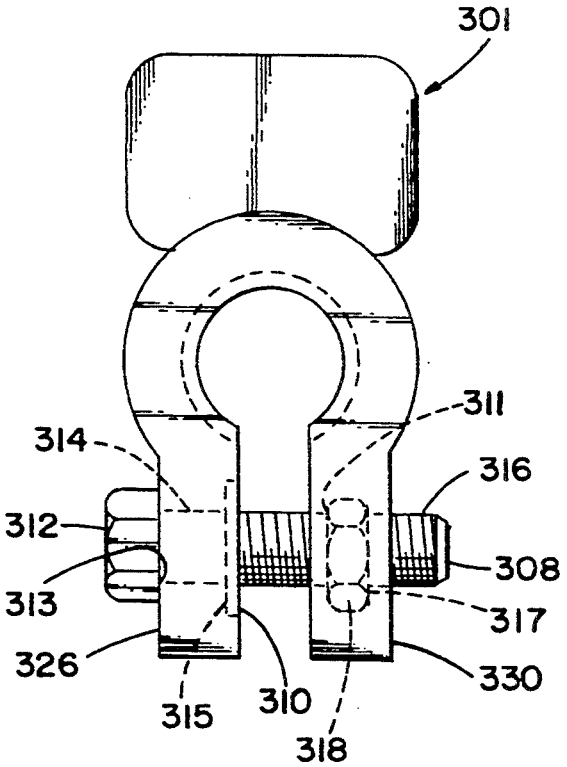
FIG. 15 illustrates a first alternative embodiment of a battery clamp utilizing a single flanged bolt with the inner flange cast adjacent to one of the clamping arm, forming a recess in the clamping arm.

FIG. 15 illustrates a first alternative embodiment of a battery clamp 301 including a bolt 308 with a head 312, an inner flange 310 and a threaded shaft 316. The bolt has a smooth radial shaft portion 314 between the head 312 and the inner flange 310. The inner flange 310 rotates freely in the clamping arm 326 when a rotational force is applied to the head 312. The threaded shaft 316 engages with the nut 318, which is embedded in the clamping arm 330.

The nut 318 is pre-threaded on the bolt 308 prior to casting and positioned in the center of the clamp arm 330. The inner flange 310 is positioned adjacent to clamping arms 330, forming a recess therein. The remaining configuration of the battery clamp is the same as that previously described.

In operation, a clockwise rotational force on the bolt 308 creates an inward force on the inner surface 313 of the head 312 against the lead material of the clamping arm 326. A corresponding inward force is created on the inner surface 311 of the nut 318, drawing the clamping arms together. When the bolt 308 is turned counterclockwise, an outward force is created on the outer surface 315 of the inner flange 310, which acts as a bearing surface against the lead material of the clamping arm 326. The rotation of the bolt 308 creates a corresponding outward force on the outer surface 317 of the nut 318, forcing the clamping arms apart.

Figure 16:
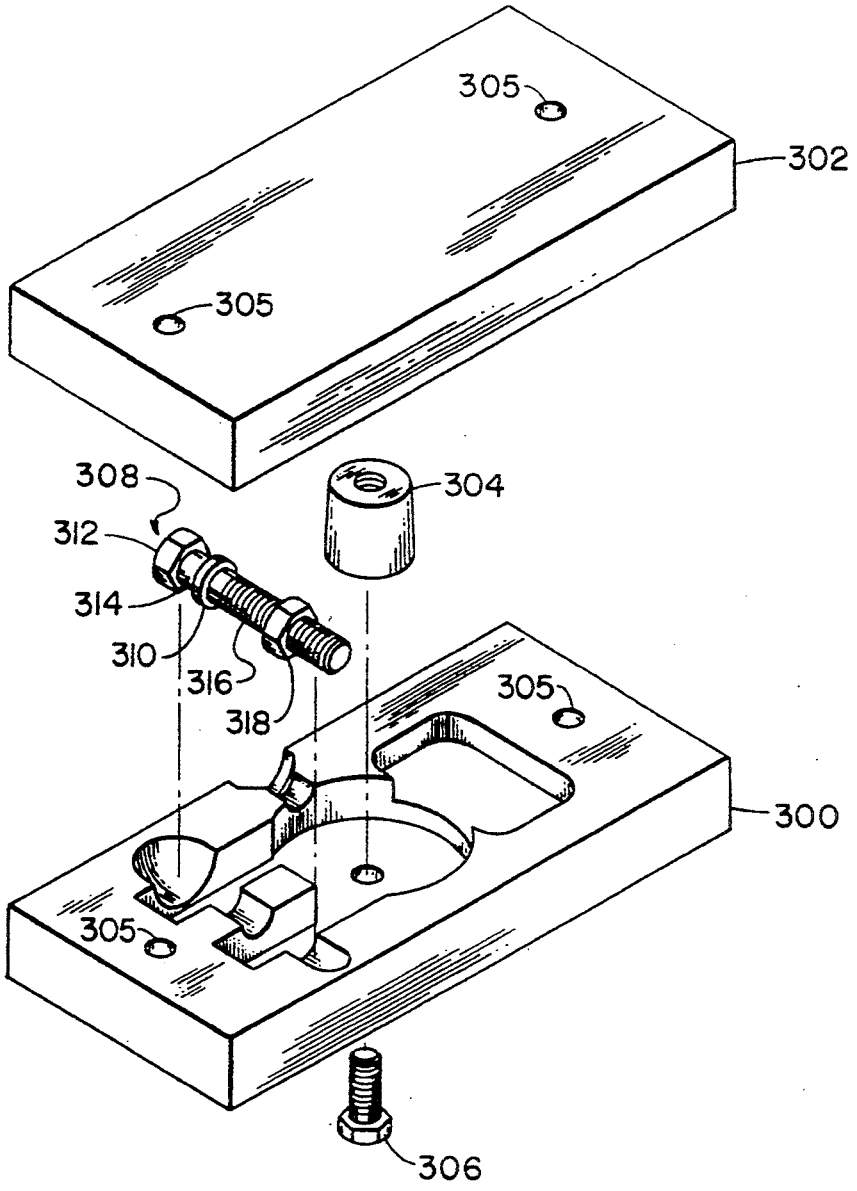
FIG. 16 illustrates an exploded perspective view of the mold of the first alternative embodiment, including the flared battery post and nut, and the single flange bolt and nut.

FIG. 16 illustrates an exploded perspective view of the mold in a first preferred embodiment of the present invention. The bottom mold half 300 and top mold half 302 are held together by bolts (not shown) passing through mold bolt holes 305. The battery post molding 304 is secured to the bottom mold half 300 by the battery post bolt 306.

The bolt 308 contains a single inner flange 310, separated from the head 312 by a smooth radial shaft 314. The threaded shaft 316 and nut 318 are substantially the same as previously discussed.

Figure 17:
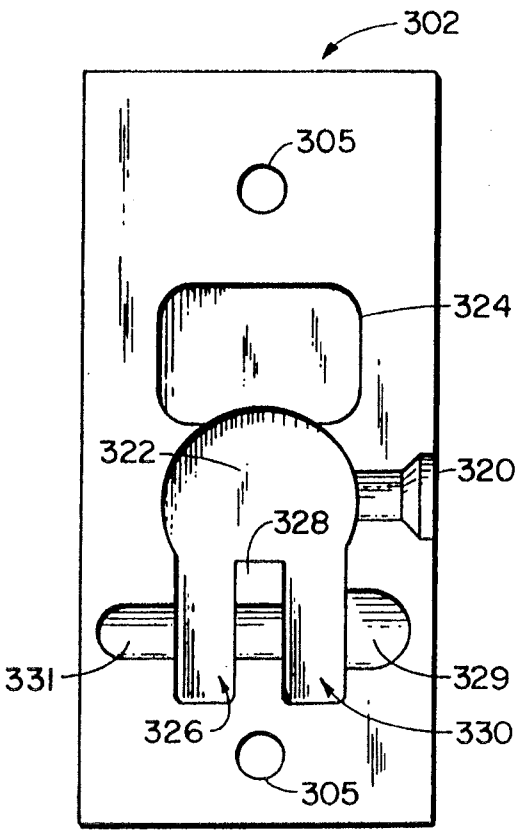
FIG. 17 illustrates a top view of the bottom half of the mold of the alternative embodiment.

FIG. 17 illustrates a top view of the top mold half 300. A pouring hole 320 for pouring the lead alloy into the mold is provided. The mold includes three primary indentations for the body of the clamp 322, the clamping area 324, and the clamping arms 326 and 330. The clamping arm separator 328 portion of the mold is interposed between the clamping arm indentations 326 and 330. Contrary to the preferred embodiment, the indentations for the bolt head 329 and the shaft 331 do not continue through the end walls of the molds 300 and 302.

Figure 19:
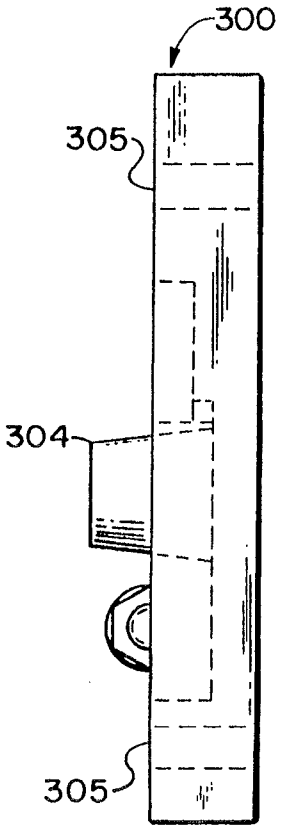
FIG. 19 illustrates a side view of the left hand side of the bottom side of the mold.
Figure 18:
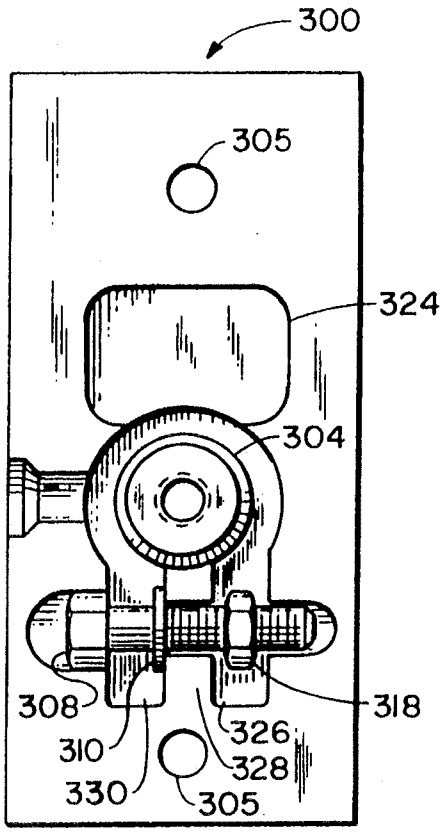
FIG. 18 illustrates a top view of the bottom half of the mold, including the positioning of the single flanged bolt prior to casing.

FIG. 18 illustrates a top view of the bottom mold half 300 with the bolt 308, nut 318 and battery post mold insert 304 positioned for casting. The bolt 308 is positioned in the mold so that the inner flange 310 is adjacent to the clamping arm separator 328. The nut 318 is pre-threaded on the bolt 308 and positioned in the mold approximately in the center of the clamping arm indentation 326. FIG. 19 illustrates a right side view of the bottom mold half 300 showing nut 318 and battery post 304.

Figure 20:
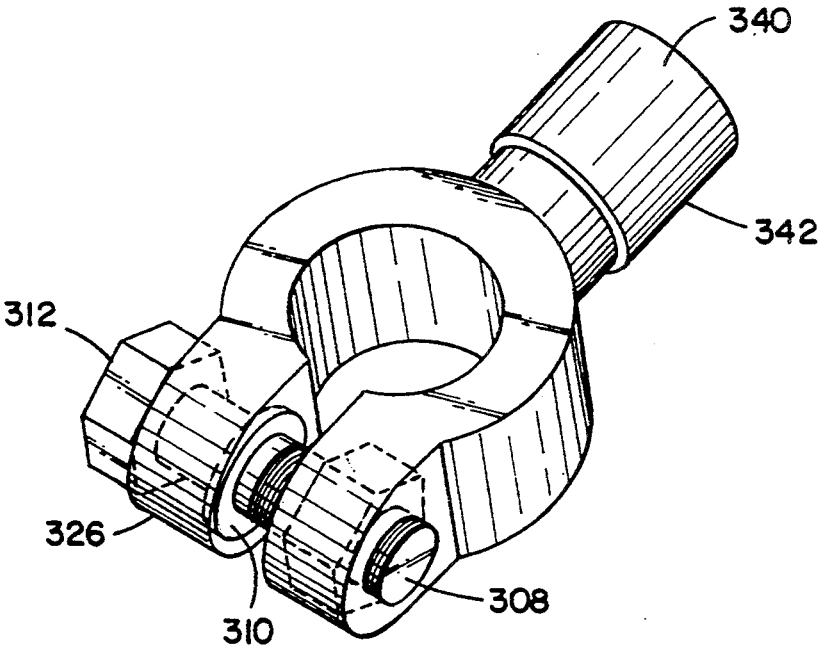
FIG. 20 is a perspective view of the battery clamp of the first alternative embodiment with an cylindrically shaped connecting member.

FIG. 20 illustrates an alternative battery clamp configuration. The battery clamp 340 is molded with a tubular shaped wire clamping member 342, whereby the wire to be attached to the battery clamp (not shown) is inserted into the tubular clamp and the clamp member 342 is compressed.

Figure 21:
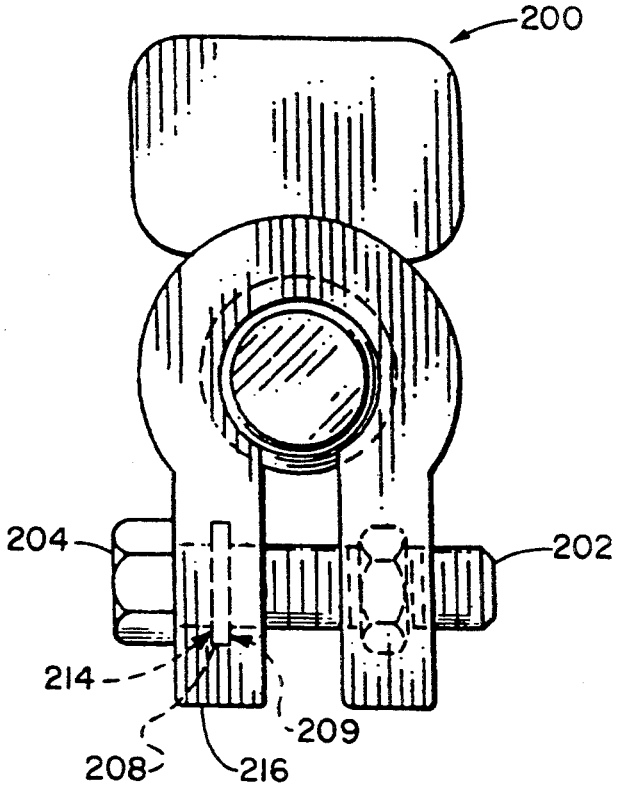
FIG. 21 illustrates a top view of another alternative embodiment where the flange is located in the interior of the clamping arm.
Figure 21A:
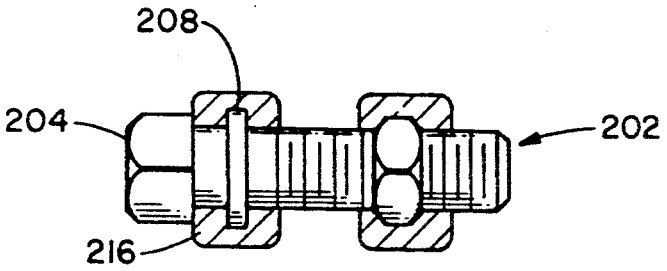
FIG. 21A illustrates an end view of the alternative embodiment of FIG. 20.

FIGS. 21 and 21A show yet another alternative embodiment of battery clamp 200 wherein bolt 202 includes a flange 208 with an outside bearing surface 214 and an inside bearing surface 209, which surface operates to retain bolt 202 in place relative to clamping arm 216. Head 204, although shown adjacent to surface of armature 216, may be spaced apart from that surface if desired.

Method of Manufacture

The method of manufacture of the present invention comprises the following steps; 1) pre-threading the nut onto the flanged bolt to a predetermined position; 2) positioning the bolt and nut in one half of the mold as shown for example in FIG. 18; 3) securing both halves of the mold together with a bolt and nut combination; 4) pouring a lead material, either lead or a lead alloy, into an opening in the mold; 5) quenching the lead filled mold in a liquid bath to accelerate the cooling process; and 6) after cooling, separating the mold pieces and removing the molded battery clamp. Because the soft lead material does not adhere to the steel bolt, the bolt turns freely to open and close the clamping arms of the battery clamp.

While particular embodiments have been described, it will be appreciated that modifications can be made without departing from the scope of the invention as defined by the appended claims. For example, a threaded insert may be substituted for the bolt and nut combination.

I claim:

1. A lead or lead alloy battery clamp comprising a pair of opposing armatures and a flanged bolt and standard polygonal nut combination, said nut having a plurality of substantially flat bearing side surface, the opposing armatures integrally cast about portions of the bolt and nut combination so that said flange is positioned in the interior of the first opposing armature, and said nut is positioned in the interior of said second armature, whereby compression and expansion forces can be transmitted to said armatures by rotating said bolt in relation to said nut.

2. The apparatus of claim 1 wherein the compression and expansion forces are transmitted to the first armature by said flange.

3. The apparatus of claim 1 wherein said flanged bolt has a head and a portion of the compression force is transmitted to the first armature by said head.

* * * * *